US009122248B2

(12) United States Patent
Raffy

(10) Patent No.: US 9,122,248 B2
(45) Date of Patent: Sep. 1, 2015

(54) CASE FOR TIMEPIECE WITH MULTIPLE CONFIGURATIONS

(75) Inventor: Pascal Raffy, Gland (CH)

(73) Assignee: Bovet Fleurier, SA, Plan-Les-Quates (CH)

( * ) Notice: Subject to any disclaimer, the term of this patent is extended or adjusted under 35 U.S.C. 154(b) by 65 days.

(21) Appl. No.: 13/444,582

(22) Filed: Apr. 11, 2012

(65) Prior Publication Data

US 2012/0257482 A1 Oct. 11, 2012

Related U.S. Application Data

(63) Continuation-in-part of application No. PCT/EP2010/065102, filed on Oct. 8, 2010.

(30) Foreign Application Priority Data

Oct. 12, 2009 (EP) ..... 09172786

(51) Int. Cl.

| | |
|---|---|
| ***G04B 37/00*** | (2006.01) |
| ***A44C 5/00*** | (2006.01) |
| ***G04B 37/14*** | (2006.01) |
| ***A44C 5/14*** | (2006.01) |
| ***G04B 37/16*** | (2006.01) |
| ***G04B 37/20*** | (2006.01) |

(52) U.S. Cl.

CPC ..... *G04B 37/148* (2013.01); *A44C 5/147* (2013.01); *G04B 37/0008* (2013.01); *G04B 37/0016* (2013.01); *G04B 37/1446* (2013.01); *G04B 37/1486* (2013.01); *G04B 37/16* (2013.01); *G04B 37/20* (2013.01)

(58) Field of Classification Search

CPC ..... A44C 5/00; A44C 5/0007; A44C 5/14; A44C 5/147; G04B 37/1446; G04B 37/0008; G04B 37/0016; G04B 37/0025; G04B 37/0033; G04B 37/0041; G04B 37/005; G04B 37/16; G04B 37/18; G04B 37/20

USPC ..... 368/276–277, 301–302, 281–282

See application file for complete search history.

(56) References Cited

U.S. PATENT DOCUMENTS

| | | | | | |
|---|---|---|---|---|---|
| 1,139,107 | A | * | 5/1915 | Depollier | 224/152 |
| 3,277,646 | A | * | 10/1966 | Howard, Sr. | 368/281 |
| 4,748,604 | A | * | 5/1988 | Lambert | 368/282 |

(Continued)

FOREIGN PATENT DOCUMENTS

GB 2309881 A * 8/1997

*Primary Examiner* — Amy Cohen Johnson
*Assistant Examiner* — Daniel Wicklund
(74) *Attorney, Agent, or Firm* — Finnegan, Henderson, Farabow, Garrett & Dunner, L.L.P.

(57) ABSTRACT

A case for a timepiece, of the wristwatch type, comprises a middle, a back and attachment members for attachment to a bracelet. The back is attached to the middle to pivot between open and closed positions, to use the timepiece as a table clock when it is in the open position. A first attachment member allows the attachment of a chain to use the timepiece as a pocket watch, and a second attachment member comprises at least one recess arranged so that one bracelet end can be inserted therein, in the open position of the back, and locked by the back when it is closed. The invention also relates to the corresponding timepiece and to an assembly comprising such a timepiece associated with adapted bracelet and chain. Advantageously, the transition from any configuration of the timepiece to another configuration can be carried out without using a tool.

20 Claims, 5 Drawing Sheets

(56) References Cited

U.S. PATENT DOCUMENTS 6,053,631 A * 4/2000 Mock et al. ..... 368/281
6,130,861 A * 10/2000 Della Felice ..... 368/276
7,433,275 B2 * 10/2008 Ellner et al. ..... 368/88
2006/0162132 A1 * 7/2006 Roy ..... 24/71 J
2006/0272134 A1 * 12/2006 Turuani et al. ..... 24/71 J
2012/0087215 A1 * 4/2012 Fantoni ..... 368/281

* cited by examiner

CASE FOR TIMEPIECE WITH MULTIPLE CONFIGURATIONS

This application is a continuation-in-part application of prior International Application No. PCT/EP2010/065102, filed on Oct. 8, 2010 and claiming priority to European (EP) Patent Application No. 09172786.7, filed Oct. 12, 2009.

TECHNICAL FIELD

The present invention relates to a case for a timepiece, of the wristwatch type, comprising notably a middle, designed to house a clockwork movement, a back and first and second attachment members for attachment to a bracelet.

More precisely, the present invention relates to such a type of case for the production of a timepiece in which the bracelet can be taken off the case without requiring the use of tools.

Specifically, the case according to the present invention is such that its back may be mechanically connected to the middle so as to be able to pivot, between at least one open position and one closed position, and to define a bearing surface in the open position in order to use the timepiece as a table clock. It is therefore advantageous to be able to remove the bracelet easily.

BACKGROUND

Wristwatches in which the case has identical bracelet-attachment members on each side, the latter optionally comprising at least one button for releasing the bracelet in order to replace it, have already been disclosed in the prior art.

Patent application GB 2 297 236 A provides an example thereof.

Moreover, patent CH 203479 describes a wristwatch in which the middle is mounted on a support so as to be able to pivot with reference to the latter and to allow the watch to be used as a table clock.

Similarly, the utility model DE 8103059U describes a watch that can be used as a wristwatch, table clock or pocket watch. For this purpose, a two-part frame is provided around the case, one part of which is able to pivot between three different positions associated with three configurations of the watch. The frame also supports members for attaching a bracelet or a chain.

The structure of this watch confers upon it a particular appearance, substantially lacking elegance, making it not very suitable for the production of a top-of-the-range watch.

SUMMARY

One main object of the present invention is to propose an alternative to the cases and timepieces that are known from the prior art, by proposing a timepiece which not only can have its bracelet easily replaced but, also, can be used in a manner other than as a wristwatch without harming its appearance.

Accordingly, the present invention relates more particularly to a case of the type mentioned above, wherein the first attachment member may be arranged to allow the attachment of a chain in order to use the corresponding timepiece as a pocket watch, and wherein the second attachment member may comprise at least one recess arranged in the middle, on its periphery and close to the back, so that one bracelet end may be inserted therein, in the open position of the back, and locked by the back, in the closed position of the latter.

By virtue of these features, the timepiece may accompany its wearer irrespective of his activity or how he is dressed, notably because its multipurpose character is obtained without harming its appearance.

Advantageously, the back may advantageously be mounted on the middle by means of a hinge, the recess being adjacent to the hinge. It is also possible to provide for a locking portion secured to the back to be placed in the recess, in the closed position of the back, so as to be able to interact with the bracelet end.

Moreover, provision can be made for the case to comprise a locking device for locking the back arranged in order to lock it in at least one preferred open angular position with reference to the middle. Such a locking device may comprise at least one male locking member and at least one female locking member, said members being arranged to interact with one another in the preferred angular position, one being secured to the middle and the other being secured to the back.

The case may also comprise an additional locking member arranged to ensure the stability of the closed position of the back against the middle.

According to a preferred embodiment, the present invention also relates to a timepiece comprising a case matching the foregoing features and to an assembly comprising such a timepiece, and a bracelet having first and second ends adapted to interact respectively with the first and second attachment members of the case, the second end of the bracelet comprising at least one spigot adapted to be inserted inside the recess of the middle. Moreover, the assembly may advantageously comprise a chain of which one end is arranged to interact with the first attachment member of the timepiece.

BRIEF DESCRIPTION OF THE DRAWINGS

Other features and advantages of the present invention will appear more clearly on reading the detailed description of a preferred embodiment that follows, made with reference to the appended drawings given as non limiting examples and in which.

DETAILED DESCRIPTION

Figure 1:
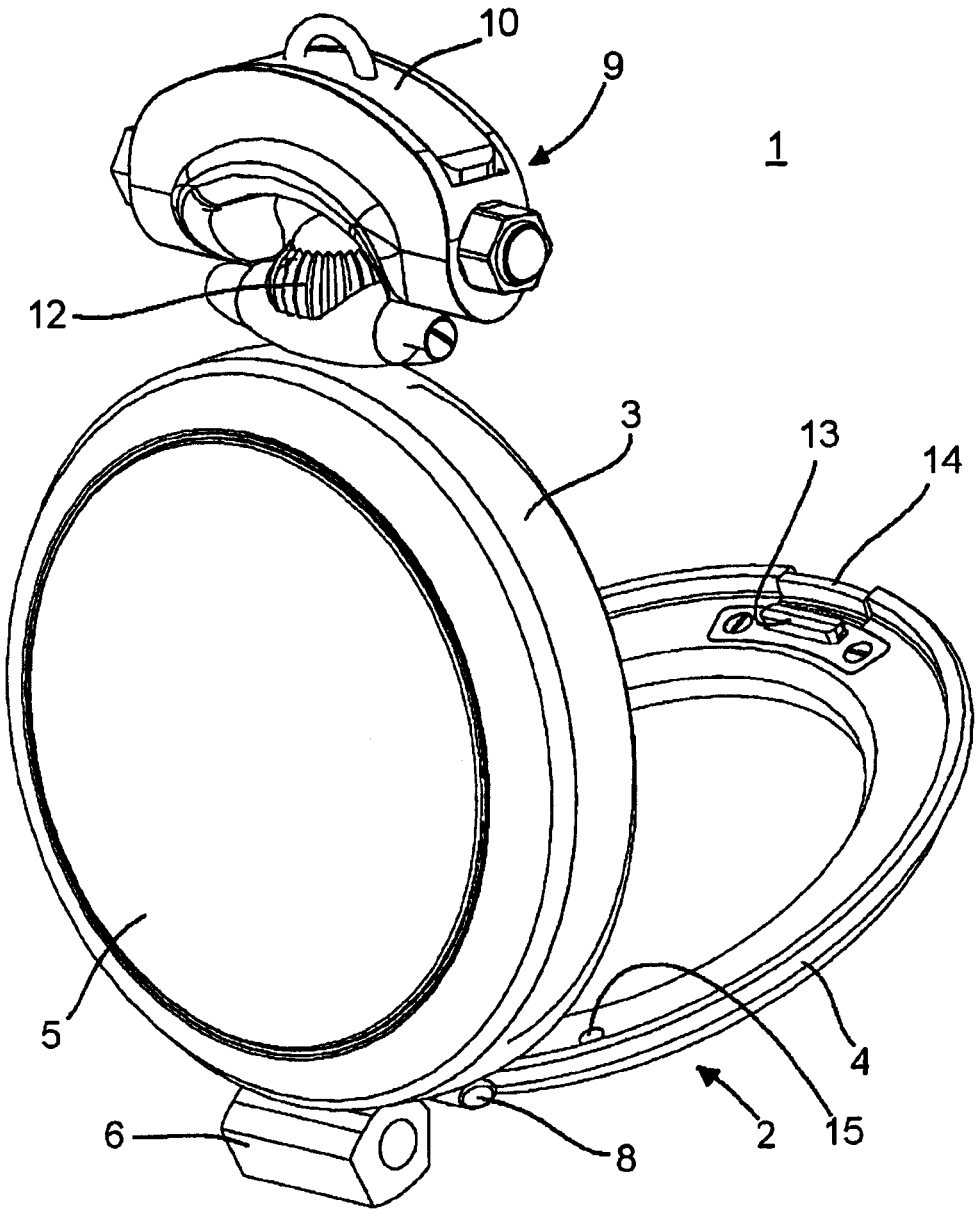
FIG. 1 represents a simplified overview in perspective of a timepiece according to a preferred embodiment of the present invention.

FIG. 1 represents a simplified overview in perspective of a timepiece 1 according to a preferred embodiment of the present invention. More precisely, the timepiece 1 may be used as a wristwatch, as a pocket watch or else as a table clock.

Accordingly, the timepiece 1 comprises a case 2 comprising a middle 3, a back 4 and a glass 5.

The back 4 is mounted so as to pivot on the middle 3 in order, on the one hand, to allow the timepiece to be used as a table clock by forming a support and, on the other hand, to provide the locking of the end 6 of one strand of bracelet, as explained in greater detail below.

As a non limiting illustration, the end 6 of the bracelet strand has been shown at six o'clock in FIG. 1, that is to say in a position adjacent to a hinge 8 connecting the back 4 to the middle 3.

Opposite the hinge, that is to say in the noon position, the middle 3 supports a bow 9 designed to allow the attachment of a second bracelet strand (not shown) or, alternatively, of a chain, of which only the end 10 can be seen in the figures and which allows the timepiece 1 to be used as a pocket watch.

The bow 9 is mounted coaxially with a conventional time-setting crown 12.

It is also evident from FIG. 1 that the case 2 has a locking member for locking the back 4 against the middle 3 comprising notably a tooth 13 that is spring-mounted and can be actuated by a button 14. The tooth 13 is designed to interact with an adapted locking surface (not visible) of the middle.

Moreover, advantageously it is possible to provide for a finger (not shown), placed in abutment against a prestressed spring in the middle, to be arranged to apply a pressure on a receiving surface 15 of the back 4 in order to disengage it from the middle 3 when the button 14 is actuated and to thus make it easier for the user to grasp the back.

Figure 2:
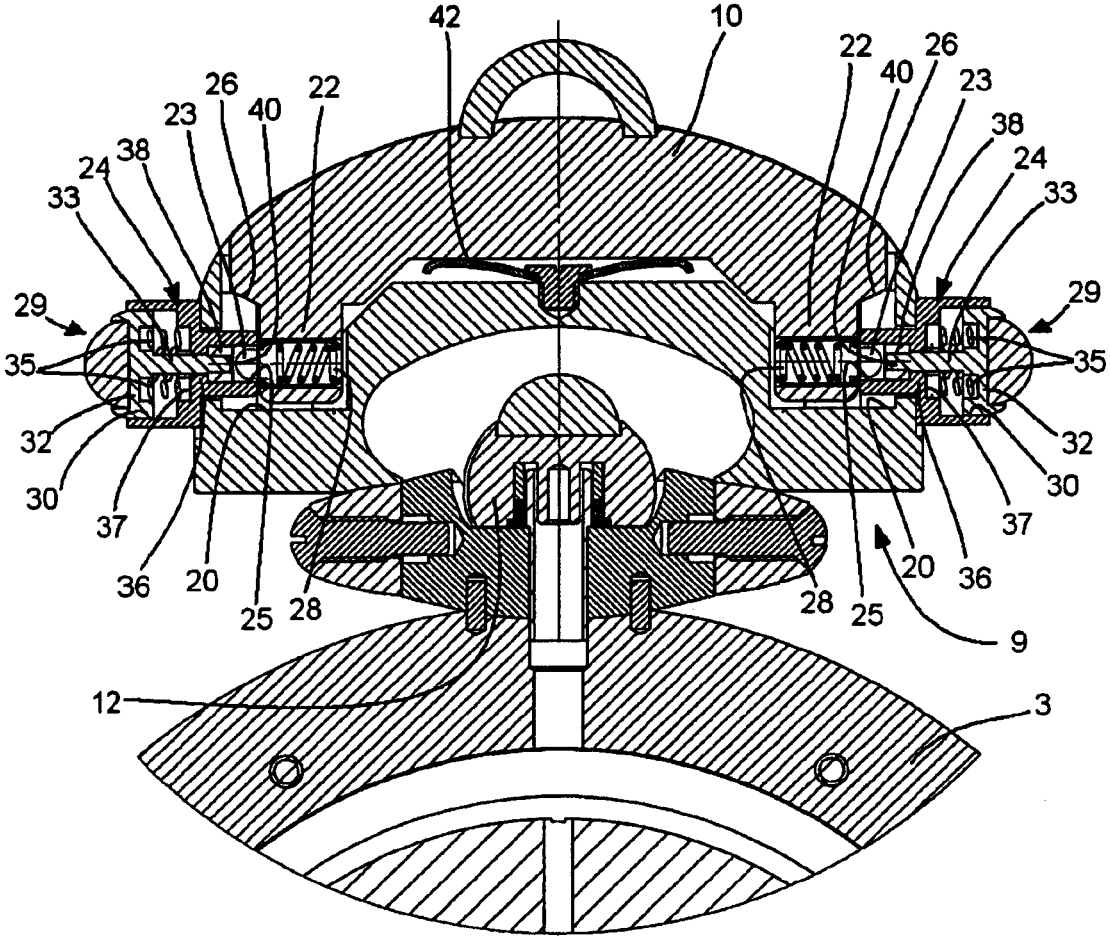
FIG. 2 represents a simplified view in section of a first construction detail of the timepiece of FIG. 1.

FIG. 2 represents a simplified view in section of a first construction detail of the timepiece of FIG. 1, more precisely of the bow 9.

The bow 9 comprises two housings 20 designed to receive the end 10 of the chain or, alternatively, the end of a bracelet strand formed in a similar manner with reference to the end 10.

The end 10 comprises two horns 22 inserted into the housings 20 and each of them comprises a pivot pin 23.

Each side of the bow 9 supports a socket 24 of which a first hole 25 emerges facing the corresponding housing 20. When the end 10 is inserted into the housings 20, the pivot pins are pushed back against one another, initially, by their interaction with inclined planes 26 arranged in the bow 9. When the pivot pins arrive facing the first holes 25 of the sockets, they separate from one another, under the effect of the actions of their respective springs 28, in order to enter the sockets and thus to lock the end 10 in the bow 9.

The sockets 24 moreover each support a button 29 placed so as to protrude relative to the exit of its second hole 30. Each button comprises a head 32, furnished in this instance with a cabochon as a non limiting illustration, supporting a stem 33 extending inside the corresponding socket.

Three springs 35 are placed between the head 32 of each button and a bearing surface 36 of the corresponding socket, so as to exert on the button a force tending to push it back out of the socket. Advantageously, the bearing surface 36 has countersinks 37 adapted to ensure a good radial hold of the corresponding spring ends.

A retaining washer 38 is secured to the stem 33 on the side of the bearing surface 36 opposite to that on which the springs 35 are situated, in order to ensure that the button 29 is held in the corresponding socket.

Each stem 33 has a length such that its end 40 is situated close to the pivot pin 23 with which it is associated when the button is at rest, that is to say when it is in its most distant position with reference to the corresponding socket.

Accordingly, when the buttons 29 are actuated by a user, against the force of the springs 35, they move toward one another and their stems 33 come into contact with the pivot pins 23 and also push them toward one another, opposing the forces of the springs 28 of the pivot pins. Preferably, the travel of the buttons corresponds substantially to the length of the pivot portion placed so as to protrude from the corresponding pivot pin when the latter is at rest.

Thus, a simultaneous pressure by the user on the buttons 29 makes it possible to release the end 10 in order to switch the timepiece from a wristwatch to a pocket watch, and vice versa, or from a wristwatch or pocket watch to a table clock.

Advantageously, a leaf spring 42 is placed at the end of the bow 9 in order to act on the end 10 and push it back with symmetry when the buttons 29 are actuated.

Figure 3:
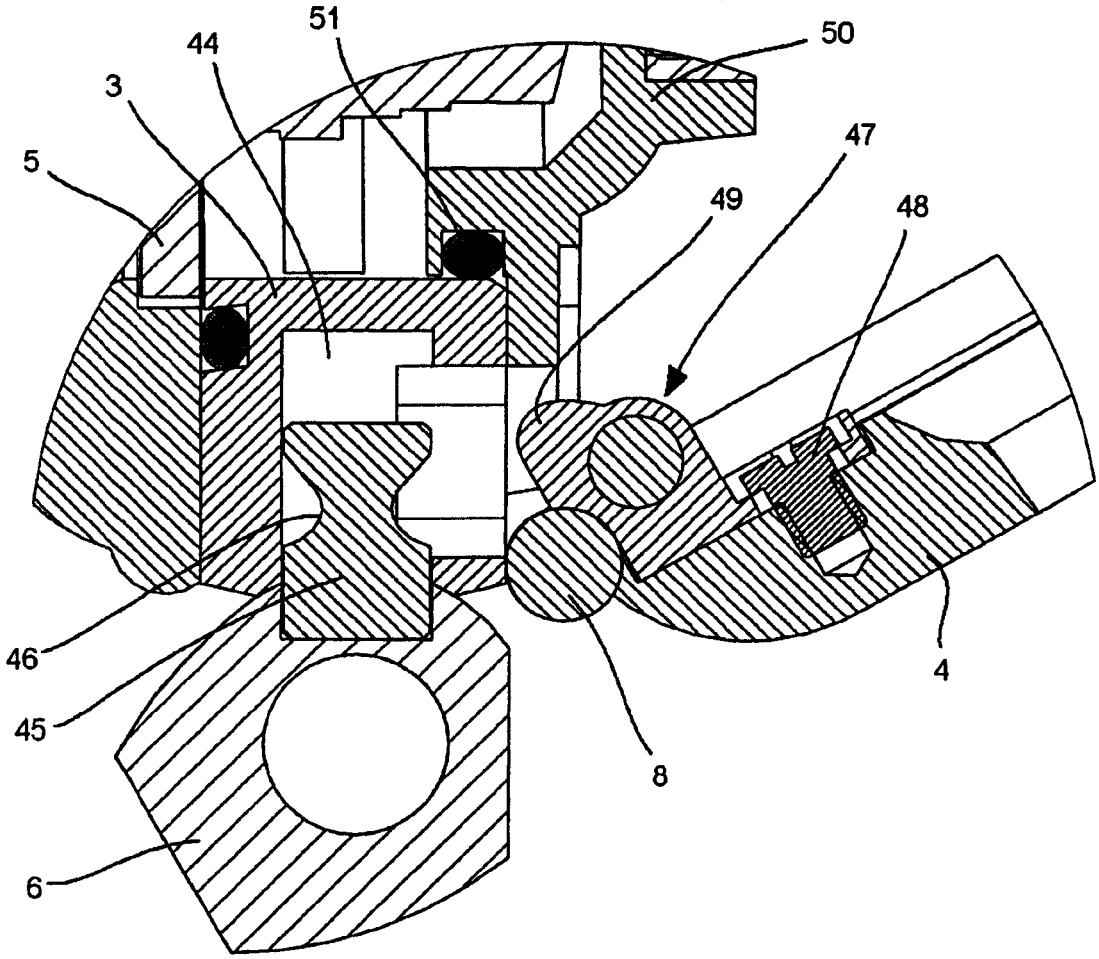
FIG. 3 represents a simplified view in section of a second construction detail of the timepiece of FIG. 1, in a first configuration.
Figure 4:
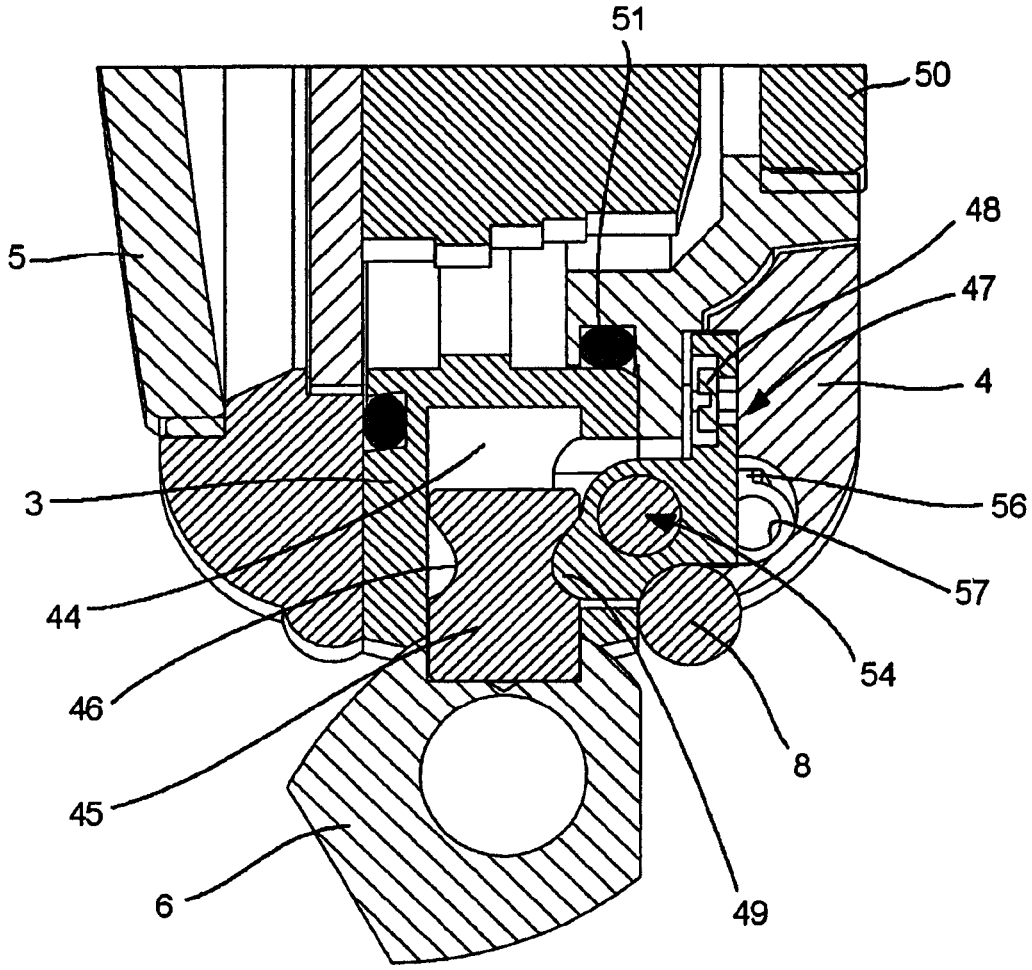
FIG. 4 represents a simplified view in section of the second construction detail of the timepiece of FIG. 1, in a second configuration.

FIGS. 3 and 4 represent views in simplified cross section, in the direction of the thickness of the case 2, of the mechanical connection used between the middle and the back of the timepiece of FIG. 1, notably of the hinge 8, in first and second respective configurations, or in an open position of the back and in its closed position.

It emerges from these figures that the middle 3 has a recess 44 adjacent to the hinge 8 and designed to receive the end 6 of a bracelet strand, more precisely a spigot 45 secured to the end 6.

The spigot 45 has the general shape of a cylinder in the periphery of which an annular groove 46 is arranged.

The spigot 45 can be engaged in the recess when the back 4 is in an open position (FIG. 3).

A locking member 47 is mounted on the back, in this instance by means of screws 48, and has a locking portion 49 with a shape that substantially complements that of the annular groove 46.

Thus, when the back is folded down against the middle in its closed position (FIG. 4), the locking portion 49 is engaged in the groove 46 and holds the spigot 45, or equally that of the associated bracelet strand.

It will be noted that, in the preferred embodiment as illustrated, an additional fixed back 50 is provided to protect the inside of the case 2 when the back 4 is open. A seal placed between the fixed back and the middle notably ensures that the corresponding assembly is sealed. It will also be noted that the hinge 8 can be mounted without distinction on the middle 3 or on the fixed back 50.

Figure 5:
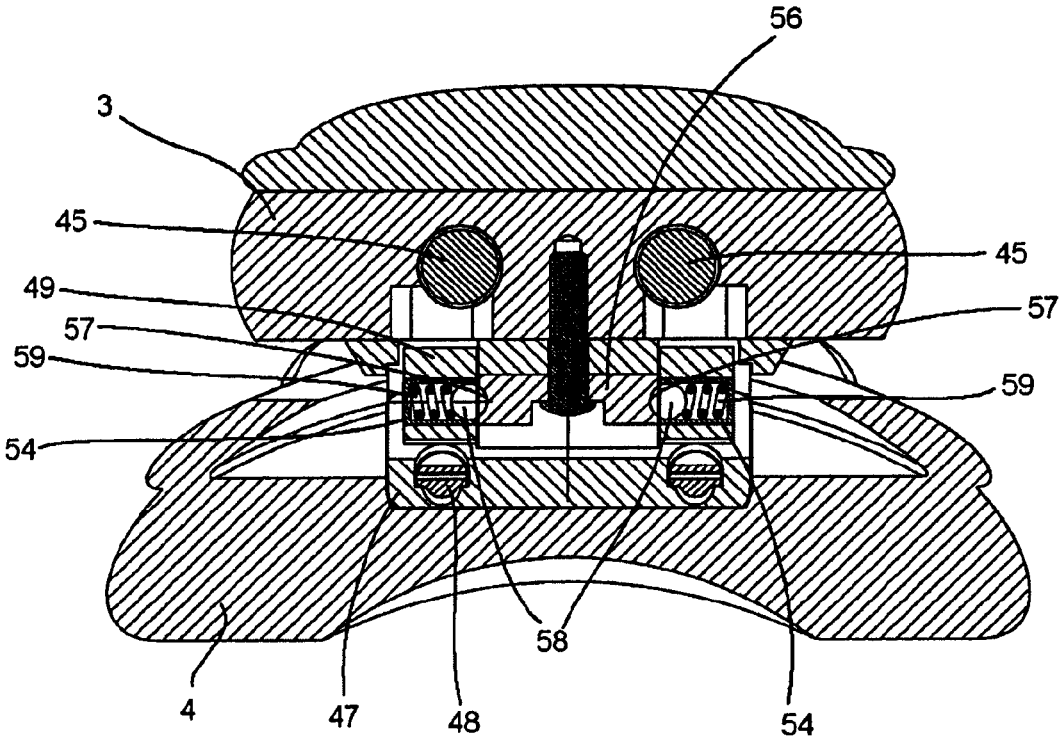
FIG. 5 represents a simplified view in section of a third construction detail of the timepiece of FIG. 1.

FIG. 5 represents a view in simplified cross section along a plane parallel to the midplane of the case 2, of the portion of the case comprising the hinge 8.

Note that the locking member 47 actually comprises two locking portions 49 designed to interact with two spigots 45 of one bracelet end, in order to improve the stability of attachment of the bracelet to the case.

Moreover, it emerges from FIG. 5 (and partially from FIG. 4) that the case 2 according to the preferred embodiment of the present invention also comprises an additional locking device of the back 4 arranged in order to lock it in at least one preferred open angular position with reference to the middle 3. This locking device makes it possible to define an angle between the back and the middle that is particularly suitable for using the timepiece 1 as a table clock. Advantageously, this angle may be of the order of 60 degrees.

This locking device comprises at least one male locking member and at least one female locking member, said members being arranged to interact with one another in the preferred angular position, one being secured to the middle and the other being secured to the back.

More precisely, the locking member 47, which is secured to the back, supports two ball locking members 54 placed facing one another and forming male locking members. Moreover, the middle supports a positioning element 56 having two holes 57 designed to interact with the ball locking members 54 in order to form female members of the additional locking device.

Thus, shown in FIG. 5 is a configuration corresponding to the preferred open position of the back 4 relative to the middle 3. In this configuration, the balls 58 are arranged to protrude into the holes 57 under the effect of the forces exerted by the springs 59 with which they are associated.

Naturally, it is possible to provide a slight friction between the two portions of the hinge 8, as an alternative or as an addition, in order to ensure the stability of any open position of the back relative to the middle. However, the implementation of a locking device as described above, while limiting as much as possible the friction between the two portions of the hinge, makes it possible to increase the level of perceived quality of the corresponding timepiece.

The foregoing description aims to describe a particular embodiment as a non limiting illustration, and the invention is not limited to the implementation of certain particular features that have just been described, such as for example the shapes specifically illustrated and described for the case 2, the bow 9, the locking devices of the back, or else the bracelet ends 6 and chain ends 10.

Specifically, those skilled in the art will find no particular difficulty in adapting the content of the present disclosure for their own requirements and producing a timepiece the construction of which adopts the features of the invention without necessarily employing, for example, two spigots 45 in order to hold the bracelet in the case or else two ball locking members in order to define a preferred open position of the back relative to the middle. Naturally, it is possible to implement a single ball locking member or any other equivalent device making it possible to define a notch, in order to define a preferred position, without departing from the context of the present invention. Similarly, the embodiment illustrated as an indication provides for three springs to be housed in each of the buttons, but it is evident that those skilled in the art will be able to adapt the number of these springs according to their own requirements, notably in terms of force of pressure necessary and of dimensions of the buttons, without departing from the context of the invention.

Note that, advantageously, the transition from any configuration of the timepiece according to the present invention to another configuration may be carried out very simply and without requiring the use of a tool.

What is claimed is:

1. A case for a timepiece, of the wristwatch type, comprising: a middle, defining a caseband and designed to house a clockwork movement, a back and first and second attachment members for attachment, respectively, to a first end and to a second end of a bracelet, said back being mechanically connected to said middle so as to be able to pivot, between at least one open position and one dosed position, and to define a bearing surface in said open position in order to use the timepiece as a table clock, wherein said first attachment member is arranged to also allow the attachment of a chain in order to use the timepiece as a pocket watch, and wherein said second attachment member comprises at least one blind recess arranged in said middle so as to emerge in said caseband, close to said back, so that said second end of the bracelet can be inserted in said blind recess, in said open position of said back, and locked by engagement of a locking member in said blind recess as said back is in said dosed position.

2. The case of claim 1, wherein said back is mechanically connected to said middle by means of a hinge, said recess being adjacent to said hinge.

3. The case of claim 2, wherein a locking portion secured to said back is placed in said recess, in the closed position of said back, so as to be able to interact with the bracelet end.

4. The case of claim 1, wherein said locking member is secured to said back and comprises a locking portion that is placed in said blind recess, in the closed position of said back, so as to be able to interact with the bracelet end.

5. The case of claim 1, wherein said first attachment member comprises at least one control member that can be actuated by a user in order to release the bracelet or the chain.

6. The case of claim 1, further comprising a locking device for locking said back, arranged in order to lock said back in at least one preferred open angular position with reference to said middle.

7. The case of claim 6, wherein said locking device comprises at least one pair of locking members comprising one male locking member and one female locking member, said locking members being arranged to interact with one another in said preferred angular position, one of said male and female locking members of a given pair being secured to said middle and the other of said male and female locking members of the same pair being secured to said back.

8. The case of claim 1, further comprising an additional locking member arranged to ensure the stability of the closed position of said back against said middle.

9. A timepiece comprising: a case comprising a middle, defining a caseband and designed to house a clockwork movement, a back and first and second attachment members for attachment, respectively, to a first end and to a second end of a bracelet, said back being attached to said middle so as to be able to pivot between at least open and closed positions, and to define a bearing surface in said open position in order to use the timepiece as a table clock, wherein said first attachment member is arranged so as to allow the attachment of a chain in order to use the timepiece as a pocket watch, and wherein said second attachment member comprises at least one blind recess opening in said caseband, close to said back, so that said second end of the bracelet can be inserted in said blind recess, in said open position of said back, and locked by engagement of a locking member in said blind recess as said back is in said closed position.

10. The timepiece of claim 9, wherein said back is mechanically connected to said middle by means of a hinge, said recess being adjacent to said hinge.

11. The timepiece of claim 10, wherein a locking portion secured to said back is placed in said recess, in the closed position of said back, so as to be able to interact with the bracelet end.

12. The timepiece of claim 11, further comprising a locking device for locking said back, arranged in order to lock said back in at least one preferred open angular position with reference to said middle.

13. The timepiece of claim 10, further comprising a locking device for locking said back, arranged in order to lock said back in at least one preferred open angular position with reference to said middle.

14. The timepiece of claim 9, wherein said locking member is secured to said back and comprises a locking portion that is placed in said recess, in the closed position of said back, so as to be able to interact with the bracelet end.

15. The timepiece of claim 9, wherein said first attachment member comprises at least one control member that can be actuated by a user in order to release the bracelet or the chain.

16. The timepiece of claim 9, further comprising a locking device for locking said back, arranged in order to lock said back in at least one preferred open angular position with reference to said middle.

17. The timepiece of claim 16, wherein said locking device comprises at least one pair of locking members comprising one male locking member and one female locking member, said locking members being arranged to interact with one another in said preferred angular position, one of said male and female locking members of a given pair being secured to said middle and the other of said male and female locking members of the same pair being secured to said back.

18. An assembly comprising:

a timepiece comprising a case comprising a middle, defining a caseband and designed to house a clockwork movement, a back, and first and second attachment members for attachment, respectively, to a first end and to a second end of a bracelet, said back being attached to said middle so as to be able to pivot between at least open and closed positions, and to define a bearing surface in said open position in order to use the timepiece as a table clock, wherein said first attachment member is arranged so as to allow the attachment of a chain in order to use the timepiece as a pocket watch, wherein said second attachment member comprises at least one blind recess opening in said caseband, close to said back, so that said second end of the bracelet can be inserted in said blind recess, in said open position of said back, and locked by engagement of a locking member in said blind recess as said back is in said closed position, and a bracelet having first and second ends adapted to interact respectively with said first and second attachment members, wherein said second end of the bracelet comprises at least one spigot adapted to be inserted inside said blind recess.

19. The assembly of claim 18, wherein said spigot has a peripheral groove arranged to interact with a locking portion of said back when said back is in said closed position.

20. The assembly of claim 18, also comprising a chain of which one end is arranged to interact with said first attachment member of the timepiece.

* * * * *

UNITED STATES PATENT AND TRADEMARK OFFICE

CERTIFICATE OF CORRECTION

PATENT NO. : 9,122,248 B2
APPLICATION NO. : 13/444582
DATED : September 1, 2015
INVENTOR(S) : Pascal Raffy It is certified that error appears in the above-identified patent and that said Letters Patent is hereby corrected as shown below:

Title page, item (73), "Assignee: Bovet Fleurier, SA, Plan-les-Quates (CH)" should read --Assignee: Bovet Fleurier, SA, Plan-les-Ouates (CH)--.

Claim 1, col. 5, line 47 and line 59, "dosed position" should read --closed position--.

Signed and Sealed this
Ninth Day of August, 2016

Michelle K. Lee

Michelle K. Lee
*Director of the United States Patent and Trademark Office*